US005676597A

United States Patent [19]

Bettoli et al.

[11] Patent Number: 5,676,597

[45] Date of Patent: Oct. 14, 1997

[54] VENTED HIP, RIDGE AND RAKE COMPOSITE SHINGLE

[75] Inventors: Steven C. Bettoli, Bound Brook; Alfredo A. Bondoc, Somerset, both of N.J.

[73] Assignee: Building Materials Corporation of America, Wayne, N.J.

[21] Appl. No.: 508,287

[22] Filed: Jul. 27, 1995

[51] Int. Cl.[6] ..... F24F 7/02

[52] U.S. Cl. ..... 454/365; 52/199

[58] Field of Search ..... 454/365; 52/57, 52/199

[56] References Cited

U.S. PATENT DOCUMENTS

| | | | |
|---|---|---|---|
| 4,876,950 | 10/1989 | Rudeen | 52/199 X |
| 4,907,499 | 3/1990 | James | 454/365 |
| 5,167,579 | 12/1992 | Rotter | 454/365 |
| 5,238,450 | 8/1993 | Rotter | 454/260 |
| 5,295,340 | 3/1994 | Collins | 52/57 X |
| 5,352,154 | 10/1994 | Rotter et al. | 454/365 |

*Primary Examiner*—Harold Joyce

*Attorney, Agent, or Firm*—Marilyn J. Maue; Joshua J. Ward

[57] ABSTRACT

A composite shingle which comprises a hip, ridge or rake overlappable shingle of standard dimension bonded to a relatively rigid, randomly aligned fibrous, air permeable mat as an underlayer having a shorter length such that upon overlapping said shingles, the forward edge of the first shingle mat abuts the rear edge of the next shingle mat and provides a self-aligning, continuous vent area below the exposed surface of the installed shingles.

12 Claims, 2 Drawing Sheets

VENTED HIP, RIDGE AND RAKE COMPOSITE SHINGLE

BACKGROUND OF THE INVENTION

Venting of roof areas through an open slot along the length of a roof at its apex or along its eaves has long been known. Generally, such vent openings are protected from entry of rain, snow, insects and the like by an air permeable web-like barrier which is installed as a sheet over the slotted area and which in turn is separately covered by a series of individual shingles which are nailed through the web to the roof deck. However, such an arrangement poses serious installation problems since, unless great care is taken to positioning and attachment of the shingle over the preinstalled web sheet, an unsightly appearance results. Such an undesirable appearance may also result from shifting of shingles over the preinstalled non-attached web after extended exposure to heat and roof structure stresses. Additionally, in such cases, the width of the venting mat sheets which are commercially available limits the size and shape of shingle overlay so that this type of venting is not adaptable to all roofing designs.

Accordingly, it is an object of the present invention to overcome the above deficiencies and to provide an aesthetically pleasing finished appearance to a roof hip, ridge or rake installation.

Another object is to significantly improve the ease of installation and time required for providing a vented roof covering.

Another object is to achieve the above objects by economical and commercially feasible means.

These and other objects of the invention will become apparent from the following description and disclosure.

THE INVENTION

In accordance with this invention there is provided an integrated shingle and venting means adapted for mounting over a roof vent or valley which comprises a shingle having a width of from about 8 to about 14 inches, preferably from about 10 to about 12 inches, of any desirable length, usually from about 10 to about 20 inches, having a granulated, weather resistant, exposed surface layer and an under surface to which is adhesively bonded at a point near or at its centerline to a relatively rigid, ¼–1 inch thick air permeable, resilient mat of randomly distributed polyester, nylon or other suitable polyolefin fibers having sufficiently dense construction to hinder entry of insects, grit and moisture through an outside opening in a roof. The mat has a minimum porosity of about 100 $m^3/m^2$/minute to allow air flow through its fibrous construction.

The shingle portion of the integrated unit is of conventional asphalt composition and of flexible construction which can be single or multiply design. Although not essential, the shingle is preferably provided with a header strip or fold of equal width at its forward exposed surface. Thus, the shingle design can be any of the folded embodiments illustrated in copending U.S. patent applications, Ser. No. 179,852, filed Jan. 11, 1994 and Docket Nos. FDN 2309 and FDN-2252/CIP filed Jun. 23, 1995 and U.S. Pat. Nos. 5,094,042 and 5,319,898 or it can be any of the conventional strip shingle designs as described in U.S. Pat. Nos. 5,167,579 and 5,195,290. Most preferred, however, is a flexible, double ply shingle having a separate, forward header strip as illustrated in the drawings. All of the shingle elements of this invention are adaptable to bending so as to conform with a corner, valley or apex of a roof over an opening therein and all composite units are designed to be installed in an overlapping manner. The preferred asphaltic type shingle is illustrated in FIG. 1 and is a 2-ply asphalt sheet having a forward header strip on its exposed surface which defines the area of overlapping upon installation of the succeeding unit.

The mat portion of the integrated shingle is of limited dimensions having a length substantially shorter than that of the shingle portion and, where a single mat unit is attached to the shingle under surface, its width is such that its side edges are approximately coextensive with the upper and lower side edges of the shingle or are recessed up to about 1 inch from the associated side edges of the shingle element when the composite shingle is in a folded position to accommodate the hip, ridge or rake of a roof. Preferably, the upper and lower side edges of the mat portion are uniformly recessed between about ¼ to about ¾ inch from the associated side edges of the shingle portion when in folded position.

When a continuous, single mat is adhered to a shingle, it is centrally attached at, or no more than ⅒th the distance of the shingle width from, the longitudinal centerline of the shingle so as to allow for movement of the mat under the overlying shingle when bended to the desired shape.

Alternatively, separate venting mats can be individually mounted on either side at any distance from the shingle centerline without allowance for distortion or displacement of side edge alignment during folding and without regard to the area of shingle attachment since no reciprocal movement between mat and shingle results upon bending.

The mat element is positioned so that its forward edge is coextensive with the forward edge of the overlying shingle portion of the shingle to which it is affixed and its length is equal to the length of the shingle portion minus the overlapping area selected for the next composite shingle upon installation. Accordingly, when two successive shingles are mounted, the leading edge of the first shingle mat abuts the rear edge of the second shingle mat; thus providing a continuous, self-aligned venting area along a roof vent.

Although many resilient randomly aligned fiber mat types are available and suitable for use herein, the preferred mats are composed of synthetic fibers joined by phenolic, aluminum oxide or latex binding agents and heat cured to provide a mat with varying mesh having between about 10% and about 15% under a standard compression test of 1360 grams with a recovery at or about 100%. An example of a commercially available mat meeting these parameters is M29 polyester scrubber pads made by Loren Products of IVAX Industries, Inc.

The present composite shingles provide weather resistance and roof venting in a simultaneous aesthetically pleasing, one-step, low cost installation procedure which removes problems of alignment between a row of shingles and vent matting while retaining maximized convection outflow, wind suction across a roof vent, weather and insect repellency, long term durability and resistance to buckling and distortion.

BRIEF DESCRIPTION OF THE DRAWINGS

Referring now to the drawings.

DESCRIPTION OF THE PREFERRED EMBODIMENT

Figure 1:
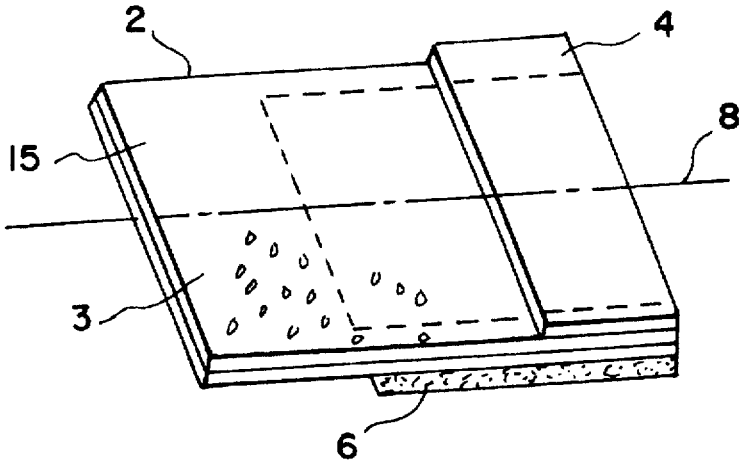
FIG. 1 is a top perspective view of a 2-ply asphaltic shingle element having a header strip of equal width at its forward edge which shingle is attached to and superimposed over a single randomly aligned fiber venting mat of smaller dimension.

In FIG. 1 a 12×12 inch composite 2-ply shingle 2 having an 8 inch longitudinal surface exposure 15 and forward header strip 4 of 4 inch length and equal width which strip defines the area of shingle overlapping to provide a high profile slate or shake like appearance when installed. The exposed area of said shingle, and optionally the upper non-exposed surface of header strip 4, is covered with granules 3 to protect against weathering. Centerline 8 of composite shingle 2, indicated by broken line, represents a fold line when the shingle is mounted over the apex of a roof. An 8×11 inch venting mat 6, composed of non-aligned polyester fibers, is adhesively attached to shingle 2 along centerline 8 thus permitting upper and bottom mat edges, 5 and 7 respectively, free lateral and contiguous movement under shingle 2 when bent. The mat placement is more clearly shown in FIG. 2 which is the perspective view of the undersurface of FIG. 1.

Figure 2:
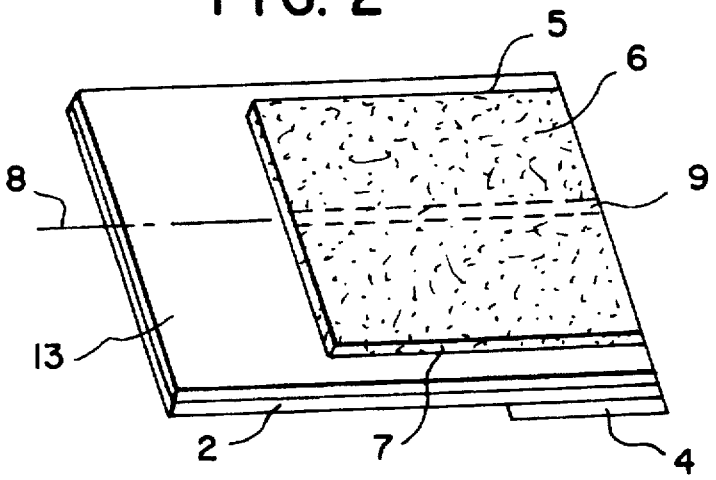
FIG. 2 is a bottom perspective view of the composite shingle shown in FIG. 1.

In FIG. 2, upper and lower mat edges are positioned ½ inch from the corresponding edges of shingle 2, forward mat edge 17 is coextensive with that of shingle 2 and the length of mat 4 is 8 inches, i.e. 4 inches from the rear edge of shingle 2. Adhesive attachment of mat 6 to shingle 2 is indicated by band 9 in dotted line; however, it is to be understood that any pattern of adhesive on the under surface of shingle 2, e.g. dots or slots can be used in place of an adhesive band and attachment can be made with one or more longitudinal bands of adhesive. However, whichever pattern is optionally selected with a single venting mat composite where the mat edges will be subjected to planar movement bending, it is important that the area of attachment be at a distance of not more that 1/10th the overall width of the shingle from the shingle centerline. When this limitation is not observed, buckling of the unitary mat leads to failure of the composite after installation.

Figure 3:
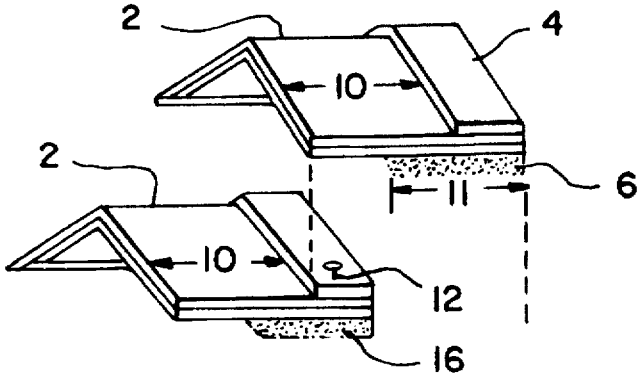
FIG. 3 represents top perspective views of the composite shingles in folded position to conform with the apex of a vented roof and indicate the position of composite shingle overlapping and mat alignment when installed.

FIG. 3 clearly shows the overlapping area between a pair of composite shingle units and indicate longitudinal mat alignment when one shingle is mounted over the other. Also shown in FIG. 3 is the attachment of the shingle to a roof deck by nailing both side edges of the composite extending downward after bending, e.g. represented by nail 12 which passes through the header strip, two plies of shingle and the mat before anchoring and securing the unit to the deck. In FIG. 3 granulated surface exposure is indicated by line 10.

Figure 4:
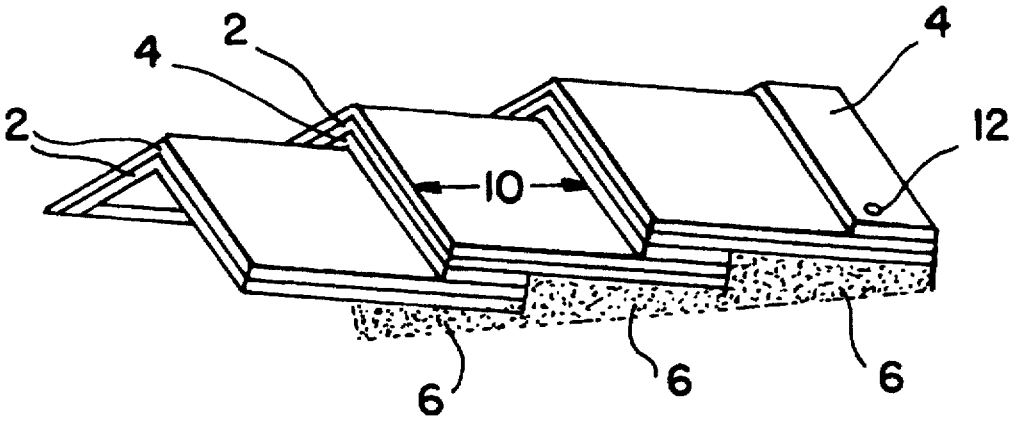
FIG. 4 illustrates a top perspective view of a series of composite shingles after installation and the continuous abutment of front and rear mat edges for a succession of mounted composite shingles.

FIG. 4 shows a series of the present composite shingles in mounted position where the forward edge of one shingle mat abuts the rear edge of a successive shingle mats thus forming a uniform venting area of aesthetically pleasing appearance along the length of a roof and covering a roof vent opening. This mat self-alignment only can be achieved by the critical placement of the mat in the composite unit.

Figure 5:
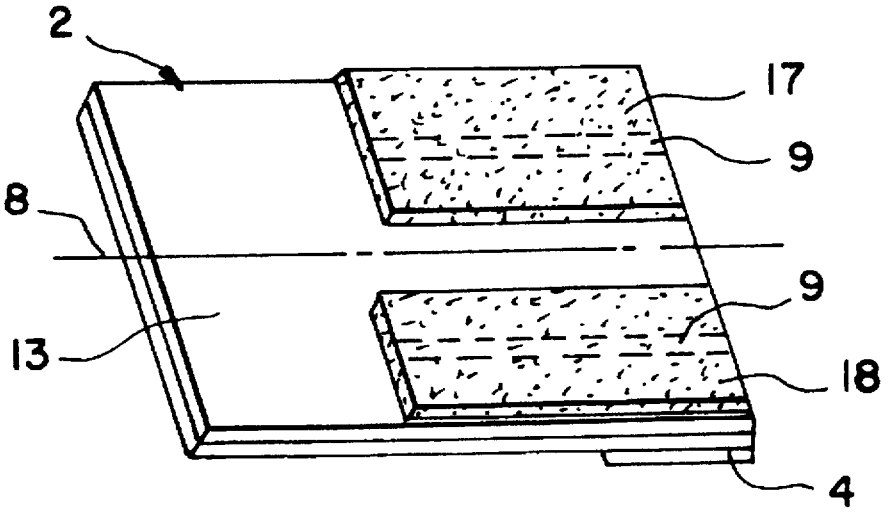
FIG. 5 is a bottom perspective view of a 2-ply asphaltic shingle element having a header strip of equal width at its forward edge which shingle under surface is attached to a pair of randomly aligned fiber venting mats of shorter length and having their terminal edges coextensive with each upper and lower edges of the shingle element.

FIG. 5 is another embodiment of the present composite shingle showing a modification of FIG. 2 wherein separate venting mats 17 and 18 are integrally and immovably mounted on undersurface 13 of shingle 2 at both sides of centerline 8. The longitudinal placement of mats 17 and 18 is similar to that shown for mat 6 in FIG. 2, i.e. with their forward edges coextensive with that of shingle 2 and the rear edges of mats 17 and 18 recessed from the rear edge of shingle 2 by the length of header strip 4.

It is to be understood that the present invention is not to be construed as limited to the drawings or preferred embodiments set forth above and that many other embodiments, modifications and variations of the composite vented shingle will become apparent from the present disclosure and are considered within the scope of this invention.

Having thus described the invention,

We claim:

1. A composite air ventable roof covering comprising a composite hip, ridge or rake shingle having (1) a selected overlappable area, (2) granules on its exposed upper surface of said shingle, (3) a centrally located centerline along the length of said shingle, and (4) a formed, relatively rigid, air permeable, resilient member composed of randomly aligned fibers attached to the undersurface of said shingle and positioned so that the forward edges of said shingle and said resilient member are coextensive and the length of said resilient member is equal to the length of said shingle minus the length of the selected overlap area.

2. The roof covering of claim 1 wherein said resilient member is a continuous sheet formed as a single air permeable mat and is longitudinally attached to said shingle at said centerline or at a distance from said centerline which is not more than 1/10th the width of said shingle.

3. The roof covering of claim 2 in an unbent state before installation wherein the upper and lower side edges of said mat are recessed so that upon bending to conform with an angle of a roof thus forming a composite shingle having two sides depending from a point of attachment, the relative planar movement of the mat sides depending from the point of attachment against the correspondingly undersurface of said shingle causes the upper and lower side edges of said mat and of the shingle to be substantially coextensive.

4. The roof covering of claim 3 wherein the mat upper and lower side edges are recessed between about ¼ and about ¾ inch from the corresponding side edges of said shingle.

5. The roof covering of claim 1 wherein a header strip having a width substantially equal to the width of the shingle, is vertically mounted over the leading edge portion of said shingle, the length of said strip defining the overlap area for the installation of the composite shingle with a similar composite shingle.

6. The roof covering of claim 1 wherein said resilient member is a pair of individual air permeable mats which are separately and fixedly attached to the shingle under surface each on opposite sides of said centerline.

7. The roof covering of claim 1 which is bent to conform with an angle of a roof and wherein the upper and lower end edges of the resilient member is coextensive with the upper and lower end edges of the shingle.

8. The roof covering according to claims 2 or 6 wherein the respective resilient members are attached to the shingle undersurface by an asphalt modified adhesive in one or more areas.

9. The roof covering as in one of claims 1 through 7 wherein said resilient member has a thickness of between about ⅛ and about 1 inch.

10. The roof covering as in one of claims 1–4 wherein said shingle is folded to provide a thickened portion at the overlap area.

11. The roof covering as in one of claims 1–4 wherein said shingle is a nonfolded sheet composed of not more than 3 plies.

12. The process which comprises bending a first composite shingle as in claim 1 to conform with a vented roof ridge, nailing said first composite shingle to said roof over the roof vent in an area provided for overlapping, similarly bending a second composite shingle substantially identical to the first, positioning said second composite shingle over the first in an overlapped manner in the selected overlapped area, nailing said second composite shingle to said roof over said roof vent in the area provided for overlapping and repeating the procedure until the entire roof ridge and roof vent is uniformly covered with said composite shingles.

* * * * *